US006884572B2

(12) United States Patent
Satake et al.

(10) Patent No.: US 6,884,572 B2
(45) Date of Patent: Apr. 26, 2005

(54) CONCENTRATED COLOR DEVELOPER COMPOSITION AND PROCESSING METHOD BY USE THEREOF

(75) Inventors: Wataru Satake, Hino (JP); Atsuro Yanata, Hachioji (JP)

(73) Assignee: Konica Corporation (JP)

( * ) Notice: Subject to any disclaimer, the term of this patent is extended or adjusted under 35 U.S.C. 154(b) by 145 days.

(21) Appl. No.: 10/371,120

(22) Filed: Feb. 21, 2003

(65) Prior Publication Data

US 2003/0203325 A1 Oct. 30, 2003

(30) Foreign Application Priority Data

Mar. 1, 2002 (JP) ..... 2002-056223
Mar. 5, 2002 (JP) ..... 2002058445

(51) Int. Cl.[7] ..... G03C 7/413
(52) U.S. Cl. ..... 430/466; 430/490
(58) Field of Search ..... 430/466, 490

(56) References Cited

U.S. PATENT DOCUMENTS 5,660,973 A * 8/1997 Ishikawa et al. ..... 430/444
5,891,608 A * 4/1999 Hashimoto et al. ..... 430/458
6,043,007 A * 3/2000 Abe ..... 430/403
6,251,573 B1 * 6/2001 Tappe et al. ..... 430/466
6,274,300 B1 * 8/2001 Seki ..... 430/466

FOREIGN PATENT DOCUMENTS

EP 0227358 7/1987
EP 0250219 12/1987

OTHER PUBLICATIONS

European Search Report EP 03 25 1109.
One page of English Abstract of Japanese Abstracts of Japan, Publication No. 10312046, Publication date Nov. 24, 1998.

* cited by examiner

*Primary Examiner*—Hoa Van Le
(74) *Attorney, Agent, or Firm*—Muserlian, Lucas and Mercanti

(57) ABSTRACT

A concentrated color developer composition packed in a container which is comprised of material exhibiting an oxygen permeability of not more than 50 ml/($m^2$·day·atm), and the concentrated color developer composition comprising a hydroxyalkyl-substituted p-phenediamine type color developing agent of not less than 0.05 mol/l, a sulfite and a hydroxylamine salt. The processing method by use of the concentrated composition is also disclosed.

10 Claims, 2 Drawing Sheets

CONCENTRATED COLOR DEVELOPER COMPOSITION AND PROCESSING METHOD BY USE THEREOF

FIELD OF THE INVENTION

The present invention relates to a concentrated color developer composition used for silver halide photographic material (hereinafter, also denoted simply as photographic material) and a processing method by use thereof, and in particular, to a concentrated color developer composition exhibiting improved storage stability even after storage at relatively high temperature, leading to superior developing performance, that is, reduced variation in gamma balance even when used as a replenisher after storage, and a processing method by use thereof.

BACKGROUND OF THE INVENTION

Photographic color developer compositions are used for processing color photographic film or paper providing an intended image. In general, such a composition contains a color developing agent as a reducing agent, for example, 4-amino-3-methyl-N-(2-methanesulfonamidoethyl)aniline, forming an intended dye upon reaction with a dye forming coupler. U.S. Pat. Nos. 4,892,804, 4,876,174, 5,354,646 and 5,660,974 describe various color developer compositions.

To replenish processing components which have been consumed in reaction or carried out by processed photographic material, color developer replenishing solution is supplied to color developing solution in a color developing tank. Such replenishment is designed so as to maintain a prescribed developing level and stability of the color developing agent.

A color developer replenishing solution is supplied in the form of at least three separate parts (or concentrated compositions), which are usually mixed immediately before use thereof. Separate plural parts are often supplied to maintain chemical activity and solubility of ingredients. Stocking these together under alkaline conditions results in deterioration or undesired reaction with each other. The parts are comprised of one containing a color developing agent, another one containing material to keep alkalinity and yet another one containing a compound such as an antioxidant. A homogeneous color developing solution can usually be obtained by mixing all of these parts with water.

In the photographic industry, reducing the number of such parts used for preparation of the replenishing solution has been desired to reduce troublesome handling. Solutions ready to use as such, so-called ready-to-use type solutions, concentrated compositions or powdery mixtures are commercially available in the field of this technology. For example, EP-A No. 0793141 (hereinafter, the term EP-A refers to a European Patent Application Publication) describes a color developer composition comprised of two parts, which can be supplied in the form of a solid or a liquid.

To provide optimum processing performance, it is generally known that concentration of ingredients of a processing solution in a processing tank must be respectively maintained within a prescribed range. The most important solvent in such photographic processing is water. Accordingly, solubility in water is an important factor for an inorganic salt and an organic salt.

In these ready-to-use type solutions, which are superior in handlability, all of the ingredients are made to objective concentrations and consequently a large amount of water is contained therein, resulting in increased costs of manufacture, transport and storage.

In the photographic industry, therefore, it is desired to provide a photographic processing composition in a concentrated form (including a color developer composition) so that a manufacturer or user has no necessity of great cost of transport or storage of a large amount of water, thereby rendering a smaller container to be usable. In the photographic industry is further desired a composition which is usable immediately after taking out from the container (for example, known as an automatic replenishing processor), without necessity of mixing various ingredients (thereby reducing errors in mixing).

Comparing a liquid concentrate with a solid mixture (e.g., powder, tablet), the liquid concentrate is convenient in usage but is more expensive for packaging relative to the solid mixture. Although powder can be highly concentrated, it is difficult to supply stable powder to respective photographic chemical compositions. Further, powder has problems such as dust, necessity of separately packaging and complicated operations for measuring and mixing. Furthermore, it takes a lot of labor and time to complete dissolution into a uniform solution state.

Another concentration form known in the art is paste or a slurry of chemicals, as described in EP-A No. 0204372 and 0800111. Such a mixture has defects such as insufficient uniformity and delayed dissolution of solid components.

Conventional "plural part type" used to provide a color developer composition is apt to be considered that mixing all components forms a single homogeneous composition. In such a concentrated form, however, interaction between chemicals and deterioration thereof are marked, adversely affecting processed photographic material and resulting in deteriorated image quality which are unacceptable in practical use.

Recently, to overcome the foregoing problems, a single part type color developer composition (single mixture) has been commercially available. However, precipitates (such as slurry) or plural solvent phases exist in such a composition so that it is necessary to conduct sufficient stirring or mixing prior to use.

Accordingly, there has been strongly desired a single part type color developer composition (a single mixture) which is homogeneously and stably concentrated. Such a concentrated composition not only reduces the cost of transporting a solution diluted with a large amount of water and to stock the solution but also eliminates the necessity to mix plural parts or stir plural phase compositions, providing a product attractive to user.

In conventional systems for processing color negative film using hydroxyalkyl-substituted p-phenylenediamine type color developing agents, it has been supposed that forming a single part is difficult and plural parts are almost mandatory.

Since it is required to control development stability, hydroxylamine salts used as an antioxidant for color developing agents greatly affect developability and it is necessary to pay close attention for consumption and oxidative decomposition thereof.

In color developer composition kits for color negative film, hydroxylamine salts are supplied separately from other ingredients, or an antioxidant other than hydroxylamine salts is used to form a single part.

JP-A No. 2001-100380 (hereinafter, the term JP-A refers to a Japanese Patent Application Publication) exemplarily describes the use of preservatives other than hydroxylamine salts. However, a color developer solution not using hydroxylamine salts differs in basic development activity, resulting in problems of development quality.

JP-A No. 2000-314948 describes the use of a hydroxylamine salt in a single part (a single liquid kit), as a comparative example of the invention, pointing out problems in storage stability. It was further proved by the inventors of this application that there were problems that developability was varied after being aged at a relative high temperature.

JP-A Nos. 8-314092 and 9-68785 discloses a one-part type color developer replenishing solution, which is preserved in a packaging material having a specified oxygen permeability. The invention described in this disclosure concerns a technique in which the use of a not concentrated, working solution type replenisher in process photographic materials, specifically a photographic material having a magnetic recording layer results in enhanced magnetic readability. However, it was proved that keeping a concentrate type replenishing solution having a relatively high color developer concentration at high temperature over a long period of time tended to cause tarry deposition in a kit or a replenishing tank, often causing uneven development when using this replenishing solution in process of photographic material.

SUMMARY OF THE INVENTION

Accordingly, it is an object of the invention to provide a single part, concentrated color developer composition which is improved in tarry deposition caused in a kit when kept at a relatively high temperature and also improved in development unevenness when using for process of photographic material.

It is an object of the invention to provide a concentrated color developer composition exhibiting reduced variation in oxidation-reduction potential even after storage at relatively high temperature, thereby effectively inhibiting variation in gamma balance between before and after storage, and a processing method by use thereof.

The foregoing problem can be solved by the following constitution:

1. A concentrated color developer composition comprising a single part, packed in a container which is comprised of a material exhibiting an oxygen permeability of not more than 50 ml/($m^2$·day·atm), and the concentrated color developer composition comprising a hydroxyalkyl-substituted p-phenylenediamine type color developing agent of not less than 0.05 mol/l, a sulfite and a hydroxylamine salt;
2. The concentrated color developer composition described in 1, wherein the concentrated color developer composition comprises the hydroxyalkyl-substituted p-phenylenediamine type color developing of not less than 0.05 mol/l, the sulfite of not less than 0.1 mol/l and a hydroxylamine salt of not less than 0.03 mol/l;
3. The concentrated color developer composition described in 1 or 2, wherein the concentrated composition comprises a compound represented by the following formulas (1) through (4):

formula (1)

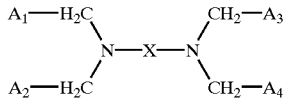

wherein $A_1$, $A_2$, $A_3$ and $A_4$, which may be the same or different represent —$CH_2OH$, —COOM or —$PO_3M_1M_2$, in which M, $M_1$ and $M_2$ each represent a hydrogen atom or an alkali metal atom; X represents an alkylene group having 3 to 6 carbon atoms, which may be different;

formula (2)

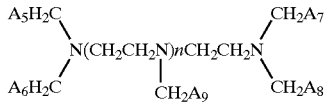

wherein $A_5$, $A_6$, $A_7$, $A_8$ and $A_9$ which may be the same or different represent —$COOM_3$ or —$PO_3M_4M_5$, in which $M_3$, $M_4$ and $M_5$, which may be the same or different, each represents a hydrogen atom or an alkali metal atom; n is 1 or 2;

formula (3)

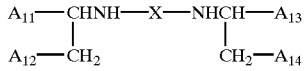

wherein $A_{11}$, $A_{12}$, $A_{13}$ and $A_{14}$, which may be the same or different represent —$CH_2OH$, —$PO_3(M_6)_2$ or —$COOM_7$, in which $M_6$ and $M_7$ each represent a hydrogen atom or an alkali metal atom; X represents an alkylene group having 2 to 6 carbon atoms or —$(B_1O)_n$—$B_2$—, in which n is an integer of 1 to 6, $B_1$ and $B_2$ are each an alkylene group which may be the same or different;

formula (4)

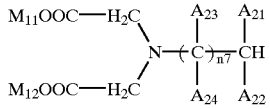

wherein $A_{21}$, $A_{22}$, $A_{23}$ and $A_{24}$, which may be the same or different represent a hydrogen atom, a hydroxy group, —$COOM_8$, —$PO_3(M_9)_2$, —$CH_2COOM_{10}$, —$CH_2OH$ or a lower alkyl group, provided that at least one of $A_{21}$, $A_{22}$, $A_{23}$ and $A_{24}$ is —$COOM_8$, —$PO_3(M_9)_2$ or —$CH_2COOM_{10}$; $M_8$, $M_9$, $M_{10}$, $M_{11}$ and $M_{12}$ each represent a hydrogen atom or an alkali metal atom; n7 is an integer of 0, 1 or 2;

4. The concentrated color developer composition for silver halide photographic materials as described in any of 1 through 3, wherein the concentrated composition further contains an alkali metal carbonate and a molar ratio of the hydroxylamine salt to the alkali metal carbonate being 1:3 to 1:30;
5. The concentrated color developer composition for silver halide photographic materials as described in any of 1 through 4, wherein the concentrated composition further contains a compound represented by the following formula (5):

formula (5)

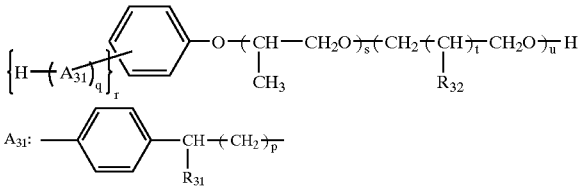

wherein $R_{31}$ represents a hydrogen atom or an alkyl group having 1 or 2 carbon atoms; $R_{32}$ represents a hydrogen atom or a hydroxyl group; p is an integer of 0 to 2, q is an integer of 1 to 3, and r is an integer of 1 to 3; $A_{31}$ is substituted for any hydrogen atom on a benzene ring; s is an integer of 0 to 50, t is 0 or 1 and u is an integer of 10 to 150;

6. The concentrated color developer composition for silver halide photographic materials as described in 5, wherein a molar ratio of the hydroxylamine salt to the compound represented by formula (5) is 1:0.0004 to 1:0.04;
7. The concentrated color developer composition described in any of 1 through 6, wherein the concentrated color developer composition further comprises a compound represented by formula (7) or a polymer having a pyrrolidone nucleus:

$$HO—(R—O)_n—H \qquad \text{formula (7)}$$

wherein R represents $—CH_2CH_2—$, $—CH_2CH_2CH_2—$ or $—CH_2—CH(CH_3)—$; and n is an integer of 1 through 30;

8. A method for processing a silver halide photographic material, wherein the concentrated color developer composition as described in any of 1 through 7 is directly supplied to a color developing tank of an automatic processor for silver halide photographic materials in accordance with information with respect to a processing volume of the photographic material;
9. The processing method of a silver halide photographic material as described in 8, wherein water is directly supplied to the color developing tank in accordance with information with respect to a processing volume of the photographic material.

A concentrated color developer composition containing a hydroxylamine salt which was used in the form of a single part, prepared in accordance with the prior art exhibited marked variation in oxidation-reduction potential after storage, adversely affecting developability, specifically gamma balance. The above-described problem was overcome by the foregoing constitution according to the invention.

DETAILED DESCRIPTION OF THE INVENTION

Figure 1:
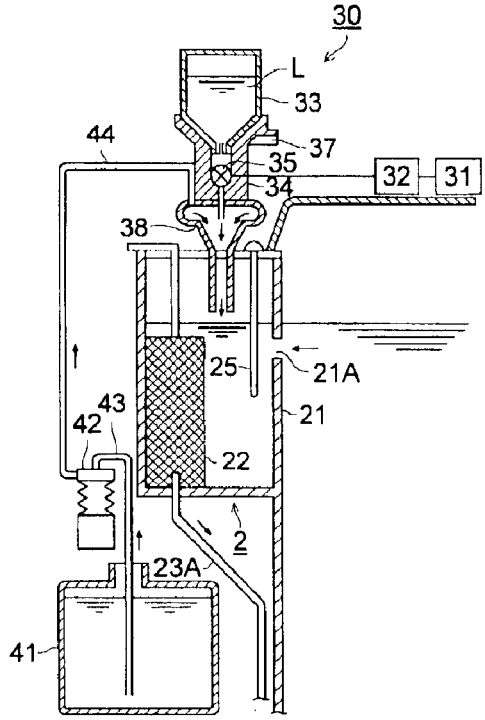
FIG. 1 illustrates a section showing one example of a means for supplying concentrated liquid replenisher and a means for supplying replenishing water.

Specific examples of preferred hydroxyalkyl-substituted p-phenylenediamine type color developing agents usable in the concentrated color developer composition are shown below but color developing agents usable in the invention are not limited to these.

(A-1)

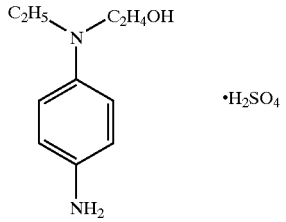

(A-2)

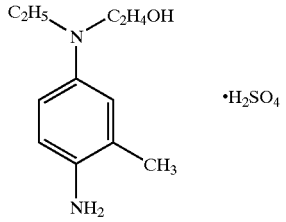

(A-3)

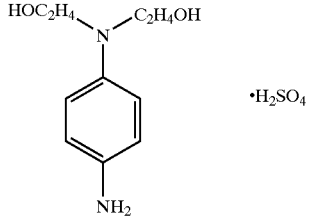

(A-4)

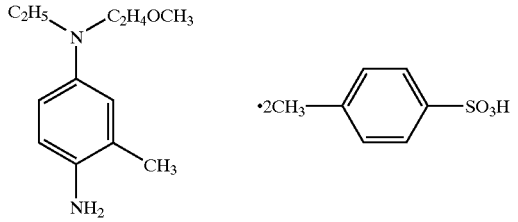

(A-5)

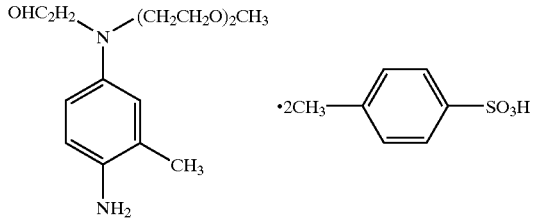

(A-6)

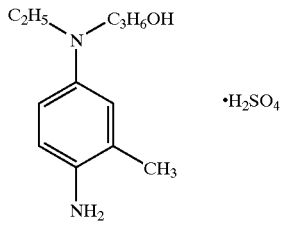

-continued (A-7)

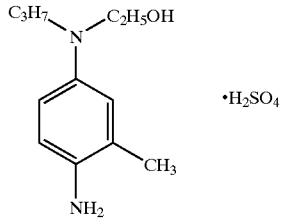

(A-8)

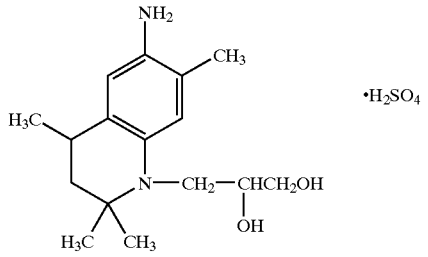

(A-9)

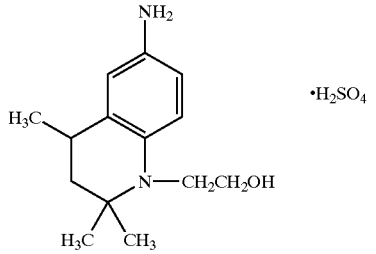

Of the foregoing, (A-2), (A-4), (A-6) and (A-8) are specifically preferred. The hydroxyalkyl-substituted p-phenylenediamine type color developing agent is used in a concentration of 0.05 mol/l or more, and preferably 0.8 to 0.5 mol/l, which may be used in combination with other color developing agents. In the case of the hydroxyalkyl-substituted p-phenylenediamine type color developing agent being less than 0.05 mol/l in a concentrated color developer composition, a sufficiently high density cannot be obtained when processing photographic materials using a color developing solution or replenisher solution thereof which is prepared by diluting the concentrated developer composition. As a result, objective effects of the invention cannot be achieved.

Sulfites usable in the invention include inorganic and organic sulfites which are capable of releasing sulfurous acid, and inorganic sulfites are preferred. Examples of preferred sulfites include sodium sulfite, potassium sulfite, sodium bisulfite, potassium bisulfite, sodium metabisulfite, and potassium metabisulfite. The concentrated color developer composition of the invention preferably contains a sulfite of at least 0.1 mol/l, and more preferably 0.2 to 1.0 mol/l. In the case of the sulfite being less than 0.1 mol/l in a concentrated color developer composition, a sufficiently storage stability cannot be achieved when processing photographic materials using a color developing solution or replenisher solution thereof which is prepared by diluting the concentrated color developer composition. As a result, desired effects of the invention cannot be achieved.

Hydroxylamine salts used in the invention are used in the form of a hydrochloride sulfate, phosphate or p-toluenesulfonate. The concentrated color developer composition of the invention preferably contains a hydroxylamine salt of at least 0.03 mol/l, and more preferably 0.05 to 0.30 mol/l. In the case of the sulfite being less than 0.03 mol/l in a concentrated color developer composition, a sufficient development activity cannot be obtained when processing photographic materials using a color developing solution or replenisher solution thereof which is prepared by diluting the concentrated color developer composition. As a result, desired effects of the invention cannot be achieved.

The concentrated color developer composition of the invention preferably contains at least one of the compounds represented by formulas (1) through (4).

Formula (1)

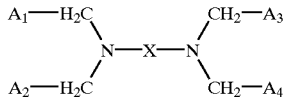

In formula (1), $A_1$, $A_2$, $A_3$ and $A_4$, which may be the same or different represent —$CH_2OH$, —COOM or —$PO_3M_1M_2$, in which M, $M_1$ and $M_2$ each represent a hydrogen atom or an alkali metal atom (e.g., sodium, potassium); X represents an alkylene group having 3 to 6 carbon atoms (e.g., propylene, butylenes, pentamethylene), which may be substituted. Examples of a substituent include hydroxy, and an alkyl group having 1 to 3 carbon atoms.

Specific examples of preferred compounds represented by formula (1) are shown below:

(1)-1 1,3-propanediaminetetraacetic acid (1)-2 2-hydroxy-1,3-propanediaminetetraacetic acid (1)-3 2,3-propanediaminetetraacetic acid (1)-4 1,4-butanediaminetetraacetic acid (1)-5 2-methyl-1,3-propanediaminetetraacetic acid (1)-6 N-(2-hydroxyethyl)-1,3-propanediaminetetraacetic acid (1)-7 1,3-propanediaminetetrakismethylenephsphonic acid (1)-8 2-hydroxy-1,3-propanediaminetetrakismethylenephosphonic acid (1)-9 2,2-dimethyl-1,3-propanediaminetetraacetic acid (1)-10 2,4-butanediaminetetraacetic acid (1)-11 2,4-pentanediaminetetraacetic acid (1)-12 2-methyl-2,4-pentanediaminetetraacetic acid These compounds (1)-1 through (1)-12 may be used in the form of a sodium or potassium salt.

In the invention, compounds represented by the following formula (2)can also be used:

Formula (2)

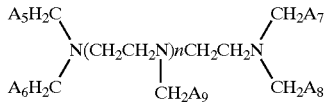

wherein $A_5$, $A_6$, $A_7$, $A_8$ and $A_9$ which may be the same or different represent —$COOM_3$ or —$PO_3M_4M_5$, in which $M_3$, $M_4$ and $M_5$, which may be the same or different, each represents a hydrogen atom or an alkali metal atom; n is 1 or 2.

Specific examples of the compound represented by formula (2) include diethylenetriaminepentaacetic acid, triethylenetetraminehexaacetic acid, diethylenetriaminepentamethylenephosphonic acid and triethylenehexamethylenephosphonic acid, and their salts (e.g., alkali metal salts such potassium, sodium and lithium). These compounds are also commercially available. Of the compounds represented by formula (2), diethylenetriamine-pentaacetic acid and its salt are specifically preferred.

In the invention, compounds represented by the following formula (3) can also be used:

Formula (3)

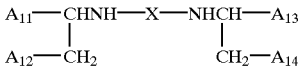

In the formula (3), $A_1$1 through $A_{14}$, which may be the same or different represent —$CH_2OH$, —$PO_3(M_6)_2$ or —$COOM_7$, in which $M_6$ and $M_7$ each represent a hydrogen atom or an alkali metal atom (e.g., sodium, potassium); X represents an alkylene group having 2 to 6 carbon atoms or —$(B_1O)_n$—$B_2$—, in which n is an integer of 1 to 6, $B_1$ and $B_2$, which may be the same or different are each an alkylene group having 1 to 5 carbon atoms Examples of the alkylene group represented by X include ethylene, trimethylene and tetramethylene. Examples of the alkylene group represented by $B_1$ and $B_2$ include methylene, ethylene and trimethylene. X, $B_1$ and $B_2$ may be substituted and examples of a substituent include hydroxy and an alkyl group having 1 to 3 carbon atoms (e.g., methyl, ethyl). "n" is an integer of 1 to 6, and preferably 1 to 4.

Specific examples of preferred compounds represented by formula (3) are shown below but are by no means limited to these.

(3)-1

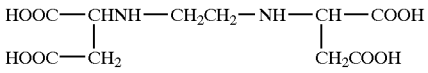

(3)-2

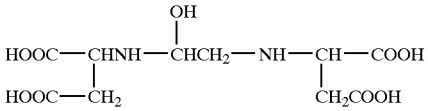

(3)-3

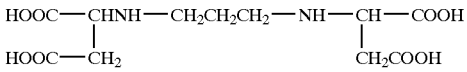

(3)-4

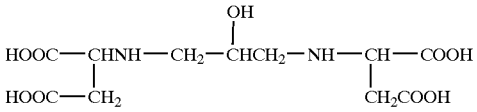

(3)-5

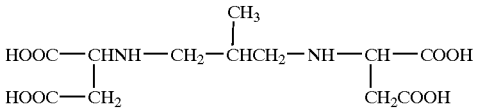

(3)-6

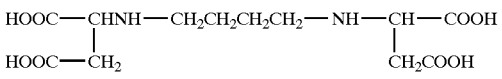

(3)-7

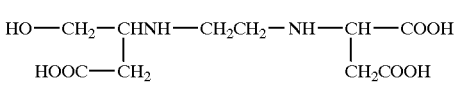

(3)-8

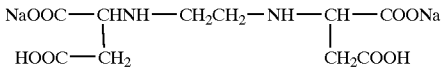

(3)-9

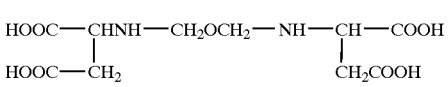

-continued (3)-10

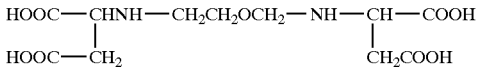

(3)-11

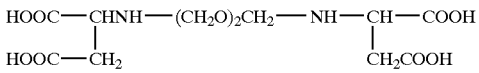

(3)-12

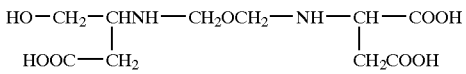

(3)-13

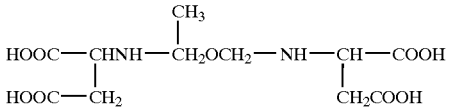

(3)-14

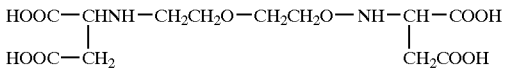

(3)-15

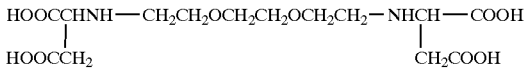

(3)-16

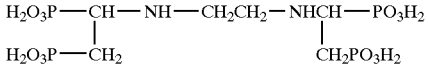

(3)-17

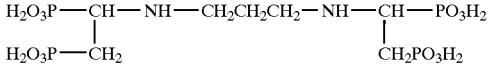

The compounds represented by formula (3) can readily be synthesized in accordance with commonly known methods. Of the foregoing compounds, (3)-1, (3)-3, and (3)-14 are specifically preferred.

In the invention, compounds represented by the following formula (4) can also be used:

Formula (4)

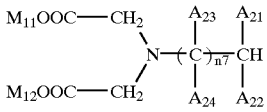

In the formula, $A_{21}$, $A_{22}$, $A_{23}$ and $A_{24}$, which may be the same or different represent a hydrogen atom, a hydroxy group, —$COOM_8$, —$PO_3(M_9)_2$, —$CH_2COOM_{10}$, —$CH_2OH$ or a lower alkyl group having 1 to 5 carbon atoms (preferably 1 to 3 carbon atom, such as methyl, ethyl, isopropyl, n-propyl), provided that at least one of $A_{21}$, $A_{22}$, $A_{23}$ and $A_{24}$ is —$COOM_8$, —$PO_3(M_9)_2$ or —$CH_2COOM_{10}$; $M_8$, $M_9$, $M_{10}$, $M_{11}$ and $M_{12}$ each represent a hydrogen atom or an alkali metal atom such as lithium, sodium and potassium, and preferably a hydrogen atom or sodium atom or potassium atom; n7 is an integer of 0, 1 or 2.

Specific examples of preferred compounds represented by formula (4) are shown below.

(4)-1

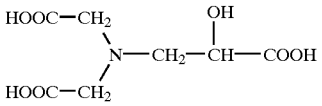

(4)-2

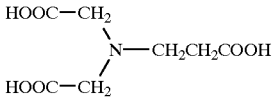

(4)-3

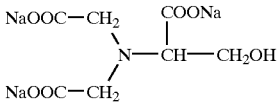

(4)-4

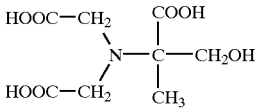

(4)-5

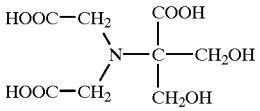

(4)-6

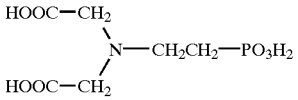

(4)-7

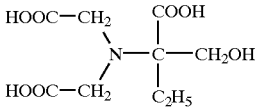

(4)-8

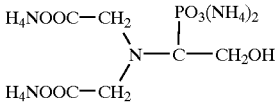

(4)-9

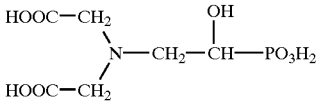

(4)-10

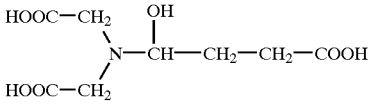

(4)-11

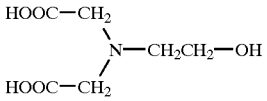

(4)-12

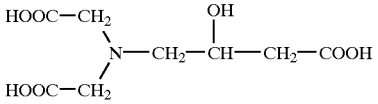

(4)-13

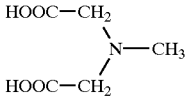

The compounds represented by formula (4) can be readily synthesized in accordance with the commonly known methods, as described in JP-A Nos. 63-26750, 63-267751, 2-115172 and 2-295954.

The concentrated color developer composition of the invention preferably contains a compound represented by the foregoing formulas (1) through (4) in an amount of 0.004 to 1.0 mol/l, and more 0.02 to 0.5 mol/l. In cases when the concentrated color developer composition is diluted at least 4 times, the content of the compound represented by formula (1) through (4) is preferably 0.001 to 0.1 mol/l, and more preferably 0.005 to 0.05 mol/l.

The concentrated color developer composition of the invention preferably contains alkali metal carbonates in terms of buffering capacity. Examples thereof include sodium carbonate, potassium carbonate, lithium carbonate, sodium bicarbonate, potassium bicarbonate, lithium bicarbonate, sodium potassium carbonate, potassium lithium carbonate and sodium lithium carbonate. The content of the carbonate is determined in its molar ratio to a hydroxylamine salt to effectively inhibit changes of oxidation-reduction potential. The molar ratio of hydroxylamine:carbonate is preferably 1:3 to 1:30, and more preferably 1:5 to 1:20. The region falling outside the range of 1:3 to 1:30 results in reduced effects of the invention.

The concentrated color developer composition of the invention preferably contains a compound represented by formula (5):

formula (5)

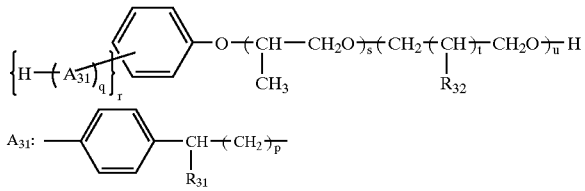

wherein $R_{31}$ represents a hydrogen atom or an alkyl group having 1 or 2 carbon atoms (e.g., methyl, methoxyethyl, ethyl); $R_{32}$ represents a hydrogen atom or a hydroxyl group; p is an integer of 0 to 2, q is an integer of 1 to 3, and r is an integer of 1 to 3; $A_{31}$ may be substituted for any hydrogen atom on a benzene ring; s is an integer of 0 to 50, t is 0 or 1 and u is an integer of 10 to 150.

Examples of preferred compounds represented by formula (5) are shown below.

(5)-1

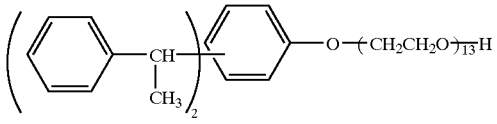

(5)-2

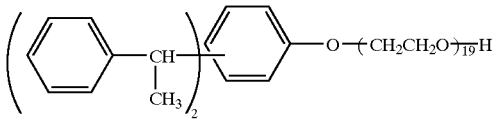

(5)-3

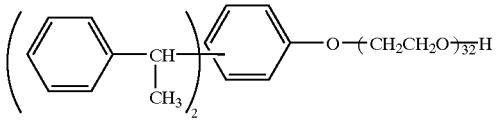

-continued
(5)-4
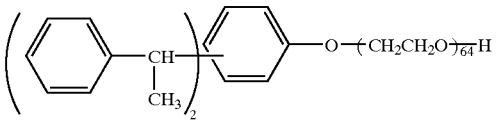
(5)-5
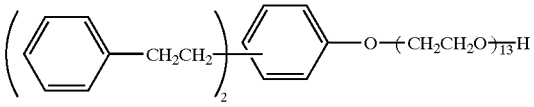
(5)-6
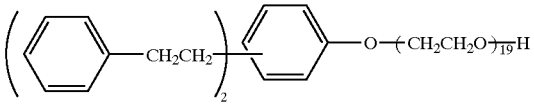
(5)-7
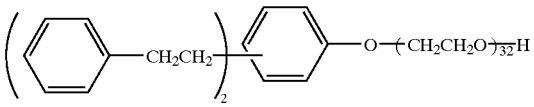
(5)-8
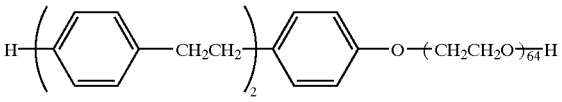
(5)-9
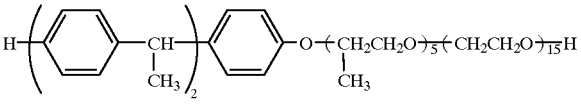
(5)-10
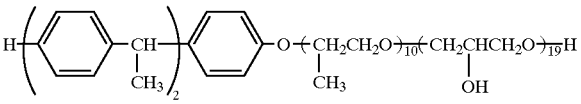
(5)-11
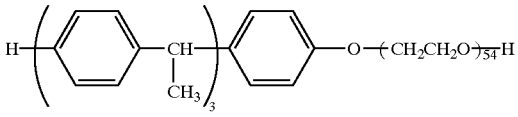
(5)-12
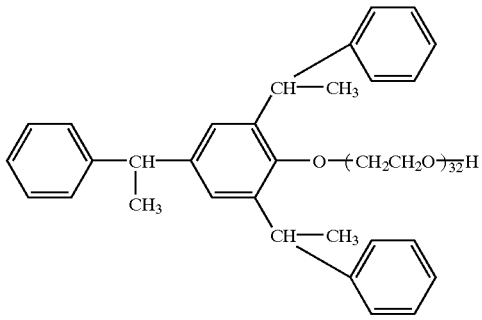
-continued
(5)-13
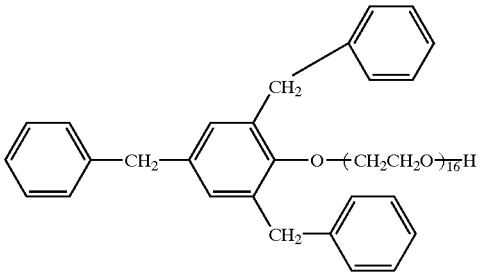
(5)-14
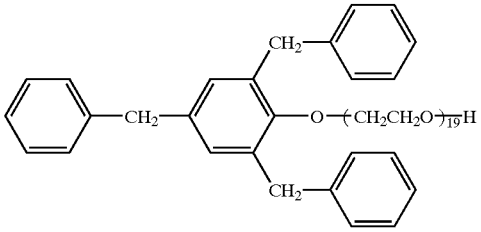
(5)-15
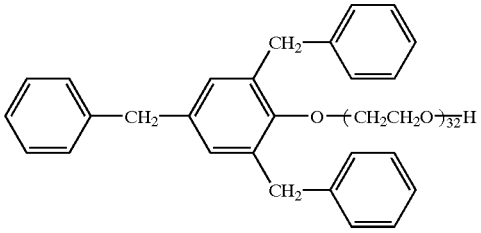
(5)-16
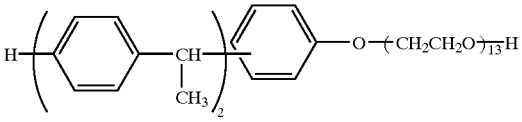
(5)-17
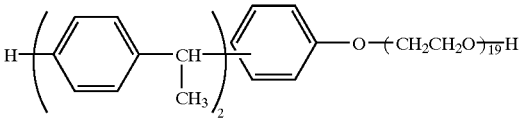
(5)-18
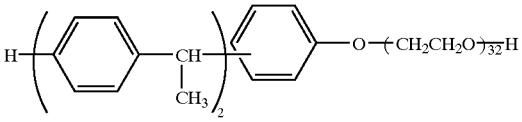
(5)-19
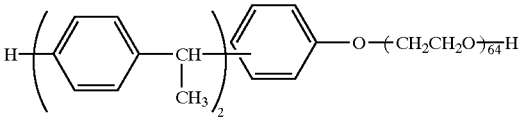
Of the foregoing compounds, compounds (5)-1, (5)-2, (5)-4, (5)-5, (5)-6, (5)-8, (5)-13, and (5)-14 are preferred.
The content of the compound represented by formula (5), hereinafter also denoted as compound (5), is determined in its molar ratio to a hydroxylamine salt to effectively inhibit changes of oxidation-reduction potential. The ratio of hydroxylamine:compound (5) is preferably 1:0.0004 to 1:0.04, and more preferably 1:001 to 1:0.01. The region falling outside the range of 1:0.0004 to 1:0.04 results in reduced effects of the invention.

The concentrated color developer composition preferably contains an antioxidant represented by the following formula (6):

Formula (6)

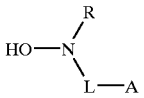

wherein R represents a hydrogen atom or an alkyl group; L represents an alkylene group; A represents a carboxyl group, sulfo group, phosphono group, hydroxy group amino group which may be substituted by an alkyl group, ammonio group, carbamoyl group or sulfamoyl group.

Antioxidants usable in the invention are preferable the foregoing compound represented by formula (6). In the formula (6), L is a straight chain or branched alkylene group having 1 to 10 carbon atoms (preferably 1 to 5 carbon atoms), which may be substituted. Preferred examples thereof include methylene, ethylene, trimethylene, and propylene. Examples of a substituent include carboxy group, sulfo group, phosphono group, phosphinic acid group, hydroxy and ammonio group which may be substituted by an alkyl group and of these are preferred carboxy group, sulfo group, phosphono group, and hydroxy. A is carboy group, sulfo group, phosphono group, phosphinic acid group, hydroxy, amino group which may be substituted by an alkyl group, ammonio group, carbamoyl group or sulfamoyl group; and of these, carboxy group, sulfo group, hydroxy, phosphono and carbamoyl group which may be substituted by an alkyl group are preferred. Preferred examples of —L—A include carboxymethyl, carboxymethyl, carboxypropyl, sulfoethyl, sulfopropyl, sulfobutyl, phosphonomethyl, phosphonoethyl and hydroxyethyl; of these are preferred carboxymethyl, carboxymethyl, sulfoethyl, sulfopropyl, phosphonomethyl and phosphonoethyl.

R represents a hydrogen atom or an alkyl group, which may be substituted; a straight chain or branched alkyl group having 1 to 10 carbon atoms, which may be substituted is preferred, and an alkyl group having 1 to 5 carbon atoms, which may be substituted is more preferred. Examples of a preferred substituent include carboxy group, sulfo group, phosphono group, phosphinic acid group, hydroxy, amino group which may be substituted by an alkyl group, ammonio group, carbamoyl group and sulfamoyl group. The substituents may be two or more. Preferred examples of R include hydrogen atom, carboxymethyl, carboxymethyl, carboxypropyl, sulfoethyl, sulfopropyl, sulfobutyl, phosphonomethyl, phosphonoethyl, and hydroxyethyl. Of these, hydrogen atom, carboxymethyl, carboxymethyl, sulfoethyl, sulfopropyl, phosphonomethyl, and phosphonoethyl are specifically preferred. L and R may combine with each other to form a ring.

Exemplary examples of the compound represented by formula (6) are shown below.

(6)-1

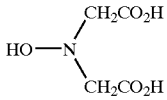

(6)-2

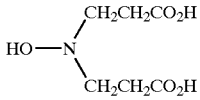

(6)-3

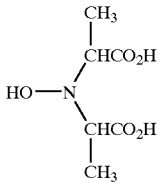

(6)-4

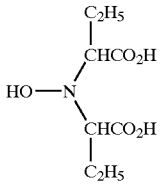

(6)-5

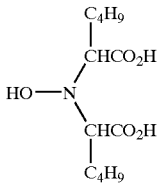

(6)-6

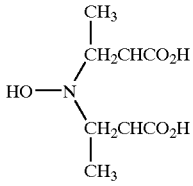

(6)-7

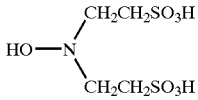

(6)-8

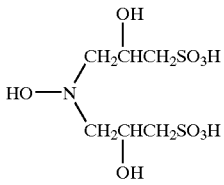

(6)-9

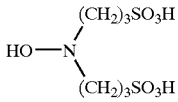

(6)-10

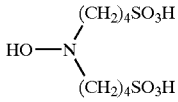

-continued
(6)-11
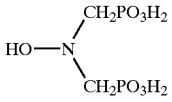
(6)-12
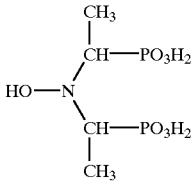
(6)-13
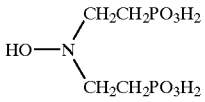
(6)-14
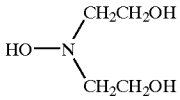
(6)-15
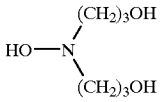
(6)-16
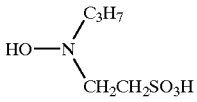
(6)-17
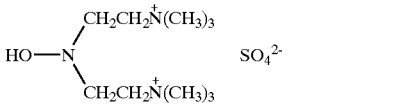
(6)-18
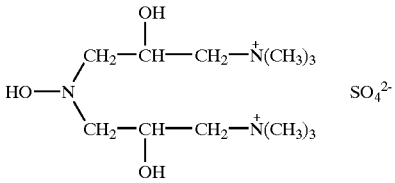
(6)-19
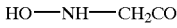
(6)-20
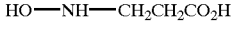
(6)-21
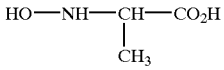
(6)-22
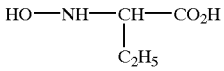
(6)-23
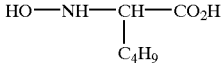
(6)-24
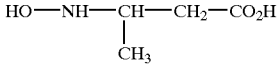
(6)-25
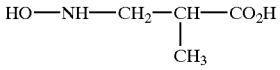
(6)-26
-continued
(6)-27
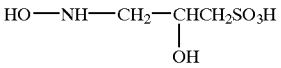
(6)-28
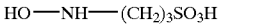
(6)-29
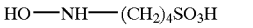
(6)-30
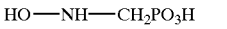
(6)-31
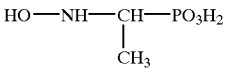
(6)-32
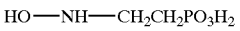
(6)-33
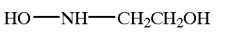
(6)-34
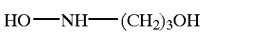
(6)-35
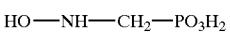
(6)-36
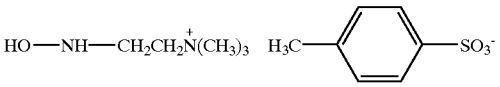
(6)-37
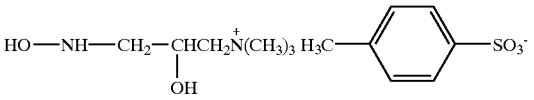
(6)-38
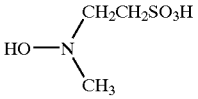
(6)-39
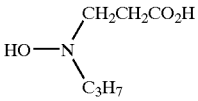
(6)-40
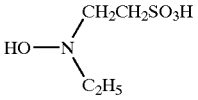
(6)-41
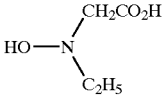
(6)-42
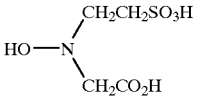
(6)-43
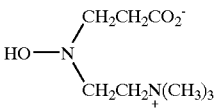
(6)-44
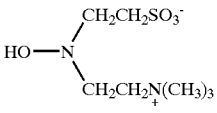

-continued (6)-45

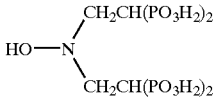

(6)-46

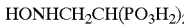

(6)-47

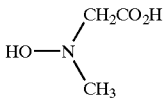

(6)-48

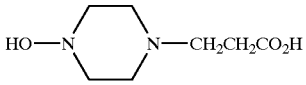

(6)-49

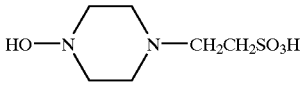

(6)-50

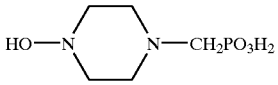

(6)-51

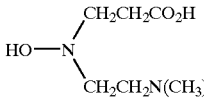

(6)-52

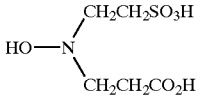

(6)-53

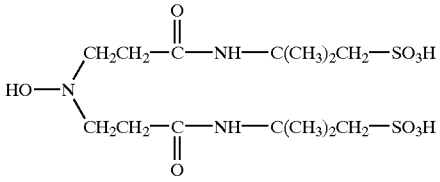

(6)-54

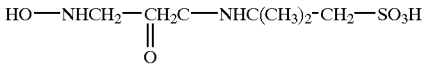

(6)-55

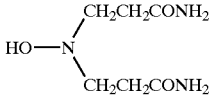

(6)-56

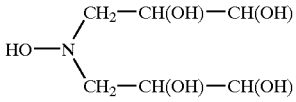

A concentrated color developer composition of the invention preferably contains a compound represented by the foregoing formula (6) of $1.2\times10^{-3}$ to 1.0 mol/l, and more preferably $1.2\times10^{-2}$ to 0.5 mol/l. The concentrated composition containing the compound represented by formula (6) is diluted at least 4 times to make color developer replenishing solution or color developer working solution. In that case, the content of the compound represented by formula (6) is preferably $3.0\times10^{-4}$ to $1.0\times10^{-1}$ mol/l and more preferably $3.0\times10^{-3}$ to $5.0\times10^{-2}$ mol/l.

In addition to the foregoing, the concentrated color developer composition of the invention may contain alkali metal hydroxides to adjust the pH.

The concentrated color developer composition relating to the invention preferably contains a compound represented by the following formula (7) or a polymer or copolymer having a pyrrolidone nucleus within the molecule structure:

$$HO—(R—O)_n—H \qquad \text{formula (7)}$$

wherein R represents $—CH_2CH_2—$, $—CH_2CH_2CH_2—$ or $—CH_2—CH(CH_3)—$; and n is an integer of 1 through 30.

Examples of the compound represented by formula (6) are shown below but are not limited to these.

(7)-1 Ethylene glycol
(7)-2 Diethylene glycol
(7)-3 Triethylene glycol
(7)-4 Tetraethylene glycol
(7)-5 Propylene glycol
(7)-6 Dipropylene glycol
(7)-7 Tripropylene glycol
(7)-8 Polyethylene glycol #200 (M.W. 200)
(7)-9 Polyethylene glycol #300 (M.W. 300)
(7)-10 Polyethylene glycol #400 (M.W. 400)
(7)-11 Polyethylene glycol #600 (M.W. 600)
(7)-12 Polyethylene glycol #1000 (M.W. 1000)
(7)-13 Polyethylene glycol #2000 (M.W. 2000)

Of these, compounds (1)-1, 2, 8, 9 and 10 are preferred.

The use of a polymer or copolymer having a pyrrolidone nucleus within the molecule promotes development, leading to improved graininess. The polymer or copolymer having a pyrrolidone nucleus within the molecular structure [hereinafter, also denoted as a compound (8)] include any polymer of which the main chain or side chain is substituted by at least one pyrrolidone nucleus at any position thereof, and which may be a homopolymer or a copolymer formed of at least two copolymerizing constituents. In the latter case, a polymer containing a pyrrolidone nucleus unit, as a copolymerizing constituent preferably accounts for at least 20%, and more preferably at least 30% of the copolymer obtained by copolymerization with other polymer(s) not containing a pyrrolidone nucleus. These other polymers not containing a pyrrolidone nucleus, which is copolymerized with the polymer containing at least one pyrrolidone nucleus in the molecular structure include any one capable of forming a hydrophilic copolymer.

The foregoing polymer or copolymer preferably has an average molecular weight of 1,000 to 70,000. Representative examples thereof are shown below:

(1) poly-N-vinyl-2-pyrrolidone*1

*1: The foregoing polymer (1) is commercially available as a trade name of PVP K-15, PVP K-17, PVP K-30, PVP K-60 and PVP K-90 from General Aniline and Film Corp., and as a trade name of Colidone 12, Colidone 17, Colidone 25, Colidone 30, Colidone 90, Rubiscol K-17, Rubiscol K-30 and Rubiscol K-90 from BASF Aktiengesellschaft.

(2) poly-N-(2-acryloyloxy)ethyl-1-pyrrolidone
(3) poly-N-glycidyl-2-pyrrolidone
(4) poly-N-acryloyl-2-pyrrolidone
(5) poly-N,N-dimethyl-N-[3-(1-pyrrolidonyl)-2-hydroxy] propyl-amine-N'-acryloylimine
(6) copoly-N-vinyl-2-pyrrolidone/N-acryloylmorpholine (molar ratio 42:58)
(7) copoly-N-vinyl-2-pyrrolidone/N-acryloylmorpholine (molar ratio 35:65)
(8) copoly-N-vinyl-2-pyrrolidone/.N-methaacryloyl-2-methylimidazole (molar ratio 35:65)
(9) copoly-N-(2-acryloyloxy)-ethyl-2-pyrrolidone/acrylic acid dimethylamide (molar ratio 60:40)

(10) copoly-N-(2-methacryloyloxy)-ethyl-2-pyrrolidone/sodium acrylate (molar ratio 75:25)

(11) copoly-N-(3-acryloyloxy)-propyl-2-pyrrolidone/methyl methaacrylate(molar ratio 65:35)

(12) copoly-N,N-dimethyl-N-[3-(1-pyrrolidonyl)-2-hydroxy]-ppropylamine-N'-acryloylimine/ethyl acrylate (molar ratio 70:30)

(13) copoly-N-vinyl-2-pyrrolidone.vinyl acetate (molar ratio 70:30)

(14) copoly-N-vinyl-2-pyrrolidone/methyl acrylate (mmolar ratio 70:30)

(15) copoly-N-vinyl-2-pyrrolidone/styrene (molar ratio 80:20)

(16) copoly-N-vinyl-2-pyrrolidone/acrylic acid amide/N-vinyl-2-methylimidazole (molar ratio 50:30:20)

(17) copoly-N-vinyl-2-pyrrolidone/N-(1,1-dimethyl-3-oxo)-butyl-acrylamide (molarratio 70:30)

(18) copoly-N-allyl-2-pyrrolidone/vinyl acetate (molar ratio 64:36)

(19) copoly-N-vinyl-2-pyrrolidone/4-vinylpyridine (molar ratio 60:40)

(20) copoly-N-vinyl-2-pyrrolidone/ethyl acrylate/acrylic acid monoethanolamine acid (molar ratio 50:45:5)

(21) copoly-N-vinyl-2-pyrrolidone/piperidinomaleamic acid piperidinic acid (molar ratio 53:47)

(22) copoly-N-vinylpyrrolidone/4-vinylpyridino-N-methyiodide (molar ratio 42:58)

(23) copoly-N-vinylpyrrolidone/maleic acid thiourea half ammonium salt (molar ratio 60:40).

The compound represented by formula (7) or the polymer or copolymer containing a pyrrolidone nucleus in the molecule structure is contained preferably in amount of 0.1 to 500 g, and more preferably 1 to 100 g per liter of a concentrated color developer composition.

The concentrated color developer composition of the invention is allowed to be included in a container, which is formed of material exhibiting an oxygen permeability of not more than 50 ml/($m^2$·day·atm), preferably not more than 20 ml/($m^2$·day·atm) and more preferably not more than 5 ml/($m^2$·day·atm). Material used for such a container in the invention may be any one, such as paper or plastic. Preferred is plastic material exhibiting an oxygen permeability of not more than 50 ml/($m^2$·day·atm), more preferably not more than 20 ml/($m^2$·day·atm) and still more preferably not more than 5 ml/($m^2$·day·atm). The oxygen permeability can be determined in the conventional manner, for example, in accordance with the method as defined in JIS 1707.

Examples of such plastic material used for a container include the following groups:

A. polyolefin type resin
B. ethylene-vinyl acetate copolymer type resin
C. ethylene-vinyl alcohol copolymer type resin
D. polyamide type resin
E. ceramics
F. acrylonitrile type resin
G. polyethylene terephthalate type resin
H. polyvinilidene halide type resin
I. polyvinyl halide type resin Of polyolefin type resin, polyethylene is preferred and linear low density polyethylene (LLDPE) is specifically preferred in terms of moisture permeability and strength. The thickness thereof is preferably 30 to 500 $\mu$m, and more preferably 50 to 300 $\mu$m.

Of polyamide type resin, nylon is preferred in terms of sticking strength and anti-pinhole. The thickness thereof is preferably 3 to 50 $\mu$m, and more preferably 5 to 30 $\mu$m. Stretched nylon is specifically preferred for the object of the invention. Ceramics are inorganic material which is mainly comprised of silicon oxide, and may be coated in vacuo with polyethylene or polyethylene terephthalate. Specific examples thereof include GL type (ceramic deposit film, available from TOPPAN PRINTING CO. LTD.).

Examples of ethylene-vinyl alcohol copolymer resin include KURARAY EVAR FILM (EF-XL, EF-F, EF-E, available from KURARAY CO., LTD.). Halogens of polyvinylidene halide type resin and polyvinyl halide type resin are, for example, chlorine, fluorine and bromine. Specific example include polyvinylidene chloride, polyvinyl chloride, polyvinylidene fluoride, and polyvinyl fluoride.

Generation of toxic gas in burning work is not preferable, so that of the foregoing resins, groups A to G are preferred in the invention and A to F are specifically preferred.

The resin usable in the invention can be employed by selecting resins satisfying conditions of the invention from those described in "Plastic Film" (Gisaku Takahashi, Nikkan-Kogyo Shinbun, Dec. 20, 1976, enlarged edition).

These materials may be singly molded or at least two kinds of materials may be laminated in a film form and used as a multi-layer film. The container may form any shape, including bottle type and pillow type. In cases where using multi-layer film for the container, the layer arrangement thereof are, for example, as follows:

(1) LLDPE/Ny (nylon)/PET (polyethyleneterephthalate)

(2) LLDPE/Ny/EVOH (EVERL)/Ny/ONy (stretched nylon)

(3) LLDPE/EVA (ethylene-vinyl acetate copolymer)/Ny (4) LLDPE/S-PE (sand polyethylene)/HDPE (high density polyethylene)/Ny/EVOH/Ny/PET (5) LLDPE/KOH (vinylide chloride coat nylon)

(6) LLDPE/GLPET (ceramic coating polyethyleneterephthalate)

(7) PE (polyethylene)/EVOH/OPP (stretched polypropylene (8) PDPE (low density polyethylene)/EVOH/PET (9) LDPE/EVOH/ONy

(10) PE/KPE (vinylidene chloride polyethylene polyester)

(11) PE/Ny

(12) PE/EVOH/Ny

(13) PE/EVOH/KPE

(14) PE/EVOH/KPET (vinylidene chloride coat PET)

(15) LDPE/EVOH/KPET

(16) EVA (ethylene-vinyl acetate copolymer)/Ny

(17) EVA/ONy

(18) EVA/EVOH/ONy

(19) LDPE/AN (acrylonitrile)

(20) LLDPE/S·PE/LLDPE/Ny/EVOH/Ny/ONy

(21) LLDPE/S·PE/HDPE/S·PE/LLDPE/Ny/EVOH/Ny/PET

(22) LLDPE/S·PE/LLDPE/Ny/EVOH/Ny/ONy

(23) LLDPE/S·PE/LLDPE/Ny/EVOH/Ny/PET

Methods for preparing multiplayer film are not specifically limited, including laminating film with film using adhesive, laminating films with fused resin, extruding two or more resins from slits and so-called co-extrusion, and film lamination methods generally used may be employed alone or in combination.

The concentrated color developer composition of the invention has practicability such that it provides color development to an imagewise exposed photographic material comprising on a support at least one silver halide emulsion layer containing imagewise distributed developable silver halide grains. Various photographic elements containing various types of emulsions (e.g., color negative film, color reversal film, color cine-film and print) can be processed using the concentrated color developer composition. Such emulsions are commonly known in the photographic art (as described in Research Disclosure).

Color development an imagewise exposed photographic material is carried out by bringing the photographic material into contact with color developing solution prepared according to the invention in an appropriate processing apparatus under optimal time and temperature conditions. Thereafter, additional processing can be conducted in the specific order known in the art employing at least one of conventional processing steps such as a development stop step, bleaching step, fixing step, bleach/fixing step, washing (or rinsing) step, stabilizing step and drying step. There are commonly known useful processing steps pf various processing protocols including process C-41 for color negative film, process RA-4 for color paper and process E-6 for color reversal film, and conditions and material thereof.

The processing time and temperature in each of the respective processing steps are known in the art. For example, color development is generally carried out at a temperature of 20 to 60° C. for a period of 15 to 250 sec. The concentrated color developer composition of the invention, which is a single part type, is diluted at least 4 time and at most 12 times to make a developer working solution or a developer replenishing solution. The dilution is preferably 4 to 10 times and water is used as a diluent. Dilution may be conducted before or during processing.

In one embodiment of the invention, the concentrated color developer composition is one chemicals mixture of a photographic processing chemicals kit including at least one of other photographic processing compositions (in a dry state or in a liquid form) including a photographic bleach composition, a photographic bleach/fixing composition, photographic fixing composition and a photographic stabilizing or rinsing composition. Such additional compositions can be prepared in the form of concentrated solution or working solution. They may be provided in a dry form (such as powder or tablet form).

In the embodiment using the concentrated color developer composition of the invention in an automatic process (hereinafter, also denoted simply as a processor), a method in which the concentrated composition is supplied directly to a processing tank is preferable in terms of eliminating a dissolution operation, compared to a method in which a replenishing solution is prepared, followed by being supplied to the tank. In such a case, supplying diluting water and the concentrated composition separately is preferred to dilute the concentrated composition. The diluting water is characterized in that the diluting water, which differs from water used to compensate for evaporation in that it is supplied in an amount calculated based on processing information of the photographic material.

Figure 2:
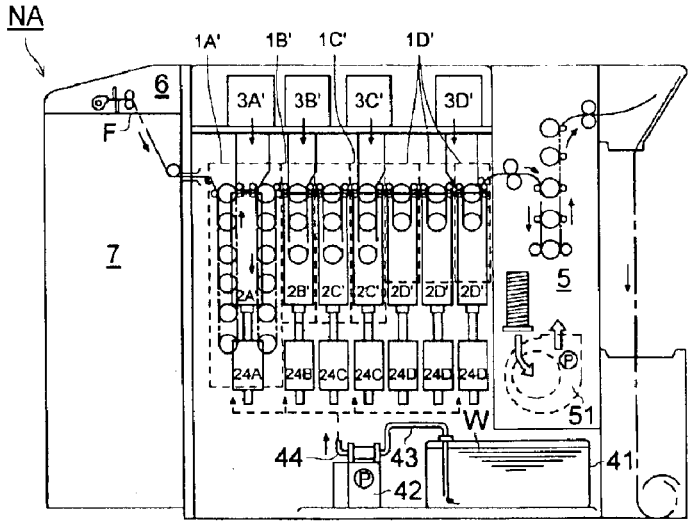
FIG. 2 shows an overall front block diagram of an automatic processor used for color negative film.

Examples of the embodiment of the invention are shown in FIGS. 1 and 2. FIG. 1 illustrates a section showing one example of a means for supplying concentrated liquid replenisher (30) and a means for supplying replenishing water (40). A detachable cartridge (33) containing concentrated liquid replenisher (L) is loaded onto a cartridge-loading board (34). After loading, the concentrated liquid replenisher (L), i.e., concentrated color developer composition relating to the invention is poured into a replenisher supplying guide member (38) in a funnel form by driving an electromagnetic valve operable according to control signals of the replenisher supply controlling means (32). On the other hand, replenishing water (W) contained in a replenishing water tank (41) is independently supplied into the supplying guide member (38) via water absorption pipe (43) and water supply pipe (44) by driving a bellows pump (42) operable in accordance with control signals of the replenisher supply controlling means (32) and then supplied in an optimal amount to circulation bath (2) together with the concentrated liquid replenisher (L) Supply of the replenishing water (W) continues after completion of supply of the concentrated liquid replenisher and is continuously conducted even after the total amount of the concentrated liquid replenisher (L) was poured so that any replenisher remaining on the internal walls of the supplying guide member (38) are washed off.

Figure 3:
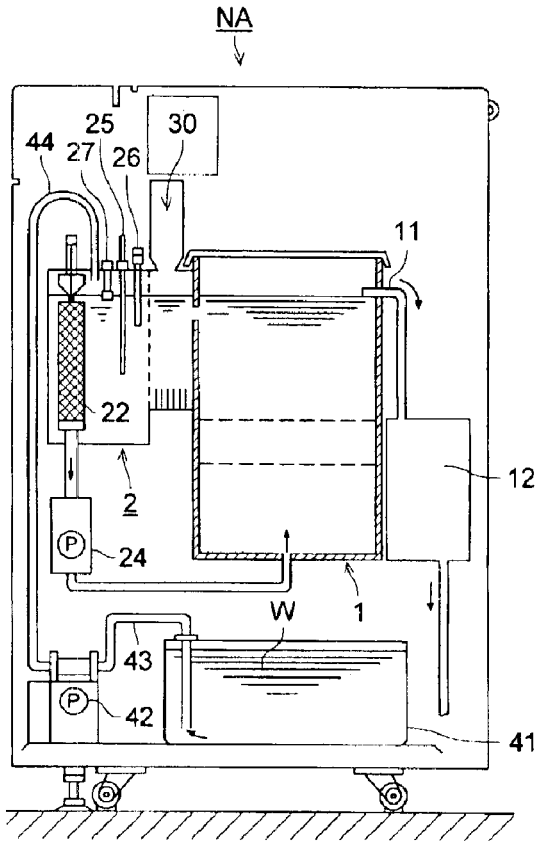
FIG. 3 shows side sectional view of the processor.

FIG. 2 shows an overall front block diagram of an exemplary automatic processor (NA) used for color negative film, which is suitable for the processing method of the invention, while FIG. 3 shows side sectional view of the processor (NA). The processor (NA) is comprised of a processing tank arrangement of a color developing tank (1A'), bleaching tank (1B'), a fixing tank (1C'), and a stabilizing tank (1D').

The processing tanks 1A', 1B', 1C' and 1D' are connected to circulation tanks 2A', 2B', 2C' and 2D', respectively, in which processing solution is circulated, while being stirred by means of circulation pumps 24A, 24B, 24C and 24D. Further, means for supplying the concentrated liquid replenisher 3A', 3B', 3C' and 3D' are installed above the respective circulation tanks 2A', 2B', 2C' and 2D' to perform controlled supply of corresponding concentrated liquid replenisher (including the concentrated color developer composition of the invention).

While replenishing water (W) contained in the common replenishing water tank (41) is supplied to the respective circulation tanks 2A', 2B', 2C' and 2D', similarly to the foregoing FIG. 2, via a bellows pump (42), water suction pipe (43) and water supply pipe (44).

In FIG. 2, a one-dot chain line shows the transport route of film (F). The film (F) is taken out from a cartridge loaded by a loading means in an operation section (6) and after processed in the color developing tank (1A'), bleaching tank (1B'), fixing tank (1C') and stabilizing tank (1D'), the film is dried by a fan heater (51) in a drying section (5) and discharged. Designation "7" is an electric device section.

In FIGS. 1, 2 and 3, "11" is a drain pipe, "12" is an effluent tank to store overflowing solution, "21" is a partition wall, "21A" is a connection window, "22" is a filter, "23A" is a circulation pipe, "24" is a circulation pump, "25" is a heater, "26" is a thermostat, "27" is a liquid level sensor and "37" is a residual content detecting means.

Figure 4:
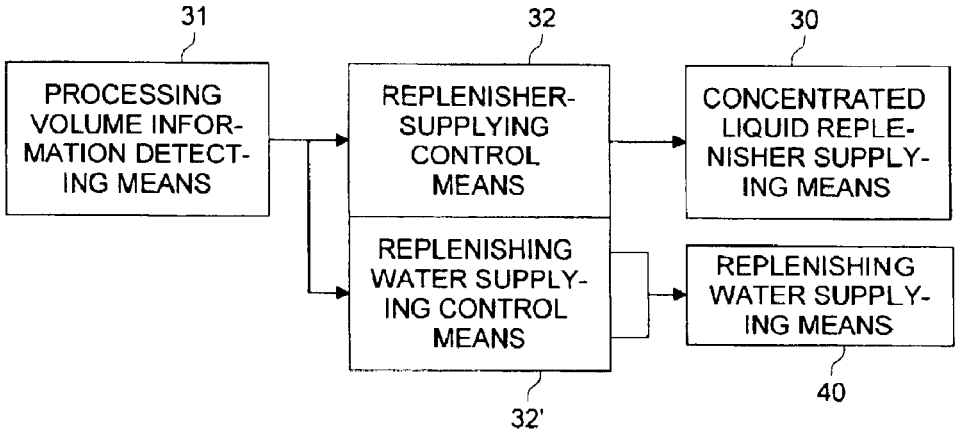
FIG. 4 is s a block diagram showing replenisher-supplying control of an automatic processor.

FIG. 4 is a block diagram showing replenisher-supplying control of an automatic processor used for application of the processing method relating to the invention.

Replenisher-supplying control means (32) controls concentrated liquid replenisher supplying means (30), in which when processing volume information of photographic material (e.g., the processing area), detected by processing volume information detecting means (31) reaches a prescribed value, a replenisher supply signal is outputted to the concentrated liquid replenisher supplying means (30). Replenisher-supplying control means (32) controls the concentrated liquid replenisher supplying means (30) so as to supply processing solution in the necessary amount to a circulation tank (2) in accordance with processing volume information.

Replenishing water supplying means (40) is a means for supplying replenishing water (W) from replenishing water tank (41) to store replenishing water in the circulation tank (2), which is provided with bellows pump (42), water absorption pipe (43), water supply pipe (44) and a hot water supplying apparatus provided with a thermostat. The replenishing water supplying means (40) also dilutes accumulated inhibitor components leached out upon reaction, while making replenishment for water carried out by photographic material and evaporated water from tank liquid surface. Replenishing water tanks or pumps may be provided in the respective processing tanks 1A, 1*b* and 1E. However, supplying common replenishing water to the respective processing tanks from a single replenishing water tank makes the processor compact. More preferably, only one replenishing water tank (41) and one pump (42) are provided in the processor, an electromagnetic valve is provided in the water replenishing route to supply water to the respective processing tanks in the needed amount at the necessary time. Alternatively, only one replenishing water tank (41) and one pump can be provided in the processor by controlling the replenishing amount by adjusting the diameter of the replenishing water pipe, thereby making the processor more compact. Further, supplying stabilizing solution overflow from the respective stabilizing tanks (1D, 1E) enables saving of a replenishing water supplying means. Replenishing water (W) in the replenishing water tank (41) is preferably thermally controlled.

As supplied water (W) are usable not only general water such as well water or tap water but also water containing commonly known compounds having no adverse effect on photographic performance, including an anti-mold such as isothiazolines and chlorine-releasing compounds, small amounts of a sulfite or chelating agent, ammonia or inorganic salts.

Replenishing water-supplying control means (32') is a means to control the replenishing water supplying means (40) by a previously programmed replenishing means to compensate for evaporated water in accordance with an environmental temperature and humidity in the installation place and/or to control the replenishing water supplying means (40) based on processing volume information detected by the processing volume information detecting means (31). Replenishing water-supplying control means (32) not only responds to processing volume information detected by the processing volume information detecting means (31) but may also be controlled based on information that a replenisher has been supplied by the concentrated liquid replenisher supplying means (30).

EXAMPLES

The present invention will be further described based on examples but embodiments of the invention are by no means limited to these.

Example 1

A concentrated color developer composition described below was prepared. The thus prepared concentrated composition was sealed in a container which was comprised of packing material exhibiting an oxygen permeability, as shown below, to prepare a single part of concentrated color developer composition.

| | |
|---|---|
| Sodium sulfite, in an amount shown in Table 1 | |
| Potassium carbonate | 200 g |
| Sodium diethylenetriaminepentaacetate | 25 g |
| Potassium bromide | 1.3 g |
| Hydroxylamine sulfate, in an amount shown in Table 1 | |
| CD-4, in an amount shown in Table 1 | |
| pH | 10.70 |
| Water to make | 1 liter |

| Layered Packing Material (oxygen permeability, ml/m$^2$ · day · atm) [outer side ← → processing solution side] |
|---|
| (a) LDPE 50 μm (2700) |
| (b) OPP 20 μm/LLDPE 40 μm (1000) |
| (c) ONy 30 μm/LLDPE 60 μm (25) |
| (d) K-ONy 15 μm/LLDPE 60 μm (5) |
| (e) K-OPP 20 μm/LLDPE 40 μm (4) |
| (f) Ny 15 μm/EVOH 12 μm/LLDPE 50 μm (2) |
| (g) PET 12 μm/Ny 5 μm/EVOH 5 μm/Ny 5 μm/LLDPE 5 μm/S.PE 20 μm/HDPE 40 μm/S.PE20/LLDPE 80 μm (1.1) |
| (h) PET 12 μm/Ny 5 μm/Ny 5 μm/LLDPE 5 μm/S.PE 20 μm/LLDPE 80 μm (0.8) |
| (i) ONy 25 μm/Ny 5 μm/EVOH 5 μm/Ny 5 μm/LLDPE 5 μm/S.PE 20 μm/LLDPE 80 μm (0.6) |
| (j) OPP 20 μm/EVOH 20 μm/LLDPE 50 μm (0.4) |

LDPE: low density polyethylene
LLDPE: linear low density polyethylene
OPP: stretched polypropylene
ONy: stretched nylon
Ny: nylon
K-ONy: vinylidene chloride coating stretched nylon
EVOH: ethylene-vinylalcohol copolymer resin
PET: polyethylene terephthalate
S.PE: sand polyethylene These concentrated color developer kits were aged in an incubator at 50° C. and 55% RH for two months and then internal state of the kit was observed.

State of Aged Kit:

A: no coloring of liquid was observed and no tar deposited,

B: slight coloring was observed but no tar deposited,

C: tarry deposits were observed on a slight portion of packing material,

D: tarry deposits were observed on a partial portion of packing material,

E: tarry deposits were observed on overall portion of packing material.

After being aged, the concentrated color developer compositions were each diluted with water to 5 times to prepare a color developer replenishing solution. Using these replenishing solutions, photographic material was continuously processed according to the following conditions:

Processing Step and Condition

| Step | Time | Temperature | Repleshing Rate | Tank Volume |
|---|---|---|---|---|
| Developing | 3 min. 15 sec. | 38.0° C. | 500 ml/m$^2$ | 16.4 lit. |
| Bleaching | 45 sec. | 38.0° C. | 130 ml/m$^2$ | 3.9 lit. |
| Fixing-1 | 45 sec. | 38.0° C. | *1 | 3.9 lit. |
| Fixing-2 | 45 sec. | 38.0° C. | 600 ml/m$^2$ | 3.9 lit. |

-continued

| Step | Time | Temperature | Repleshing Rate | Tank Volume |
|---|---|---|---|---|
| Stabilizing-1 | 30 sec. | 38.0° C. | *2 | 3.9 lit. |
| Stabilizing-2 | 30 sec. | 38.0° C. | *2 | 3.9 lit. |
| Stabilizing-3 | 30 sec. | 38.0° C. | 1000 ml/m$^2$ | 3.9 lit. |
| Drying | 1 min. | 55° C. | | |

*1: Cascade flow from 2 to 1
*2: Cascade flow from 3 to 2 and from 2 to 1

A color developer starting solution, bleaching solution, fixing solution and stabilizing solution were each prepared according to the following formulas.

Color Developer Working Solution (Per Liter)

| | |
|---|---|
| Sodium sulfite | 2.0 g |
| Potassium carbonate | 40 g |
| Pentasodium diethylenetriaminepentaacetate | 4 g |
| Potassium bromide | 1.5 g |
| Potassium iodide | 2 mg |
| Compound shown in Table 1 | 5 g |
| CD-4 | 4.5 g |
| pH | 10.00 |

(The pH was adjusted with sulfuric acid or sodium hydroxide)

| Bleaching solution (per liter) | Worker | Concentrate |
|---|---|---|
| Sodium 1,3-propylenediamine-tetraacetate iron (III) | 133 g | 190 g |
| 1,3-propylenediaminetetra-acetic acid | 5 g | 7 g |
| Ammonium bromide | 60 g | 90 g |
| Maleic acid | 40 g | 60 g |
| Imidazole | 10 g | 15 g |
| pH | 4.5 | 3.5 |

Water was added to make 1 liter and the pH was adjusted with ammonia water or 50% sulfuric acid.

| | Worker | Concentrate |
|---|---|---|
| Fixing solution (per liter) | | |
| Ammonium thiosulfate | 200 g | 400 g |
| Sodium sulfite | 15 g | 30 g |
| Disodium ethylenediaminetetraacetate | 2 g | 4 g |
| pH | 7.0 | 7.0 |
| Stabilizing solution (per liter) | | |
| m-Hydroxybenzaldehyde | 1.0 g | 20 g |
| Disodium ethylenediaminetetraacetate | 0.6 g | 12 g |
| β-Cyclodextrin | 0.2 g | 4 g |
| Potassium carbonate | 0.2 g | 4 g |
| pH | 8.5 | 9.0 |

In the running process, commercially available photographic film, Konica Color CENTURIA 800, CENTURIA 400 and CENTURIA 100 (each of which were 35 mm side, 24 exposure) were used in a ratio of 50:25:25. The film was exposed by making practical camera exposure.

Processing was run using the same photographic film and processing solutions as used in Example 5. Using an automatic processor, KP-46QA (produced by Konica Corp.), exposed films were processed in a volume of 30 rolls per day until the replenished volume reached 3 times the processing tank volume.

At the start of running process, photographic material (Konica Color CENTURIA 800) which was exposed through an optical wedge was processed to determine a yellow density in maximum density areas (Dmax-Y).

Further, using Konica Color CENTURIA 800 (35 mm size, 36 exposure), a gray plate was photographed with a camera, NIKON (produced by NIKON CORP.) at F4 to evaluate development uniformity of gray-exposed areas. After completion of running process, five rolls of photographed films were processed for each running process and visually evaluated with respect to development uniformity, based on the following criteria:

A: no unevenness in development was observed,

B: slight unevenness was observed in 1 to 5 frames but acceptable in practical use, C: unevenness was evidently observed in 1 to 5 frames, D: unevenness was evidently observed in 6 or more frames, E: unevenness was evidently observed in 12 or more frames.

Further, similarly to the start of running process, photographic material which was exposed through an optical wedge was again processed to determine an yellow density in maximum density areas. Variation in Dmax-Y (denoted as ΔDmax-Y), as defined below was evaluated:

$$Dmax\text{-}Y = (Damx\text{-}Y \text{ at the completion of running process}) - (Dmax\text{-}Y \text{ at the start of running process})$$

Results thereof are shown in Table 1, together with evaluation with respect to state of an aged kit and development uniformity.

TABLE 1

| Expt. No. | Packing Material | Oxygen Permeability (ml/m$^2$ · day · atm) | SS (g/l) | HAS (g/l) | CD-4 (mol/l) | State of Aged Kit | ΔDmax-Y | Development Uniformity | Remark |
|---|---|---|---|---|---|---|---|---|---|
| 1-1 | a | 2700 | 30 | 30 | 0.1 | D | −0.25 | E | Comp. |
| 1-2 | b | 1000 | 30 | 30 | 0.1 | D | −0.22 | D | Comp. |
| 1-3 | c | 25 | 30 | 30 | 0.1 | C | −0.12 | B | Inv. |
| 1-4 | d | 5 | 30 | 30 | 0.1 | B | −0.10 | B | Inv. |
| 1-5 | e | 4 | 30 | 30 | 0.1 | B | −0.08 | B | Inv. |
| 1-6 | f | 2 | 30 | 30 | 0.1 | B | −0.09 | B | Inv. |

TABLE 1-continued

| Expt. No. | Packing Material | Oxygen Permeability (ml/m$^2$ · day · atm) | SS (g/l) | HAS (g/l) | CD-4 (mol/l) | State of Aged Kit | ΔDmax-Y | Development Uniformity | Remark |
|---|---|---|---|---|---|---|---|---|---|
| 1-7 | g | 1.1 | 30 | 30 | 0.1 | B | −0.06 | B | Inv. |
| 1-8 | h | 0.8 | 30 | 30 | 0.1 | B | −0.07 | B | Inv. |
| 1-9 | i | 0.6 | 30 | 30 | 0.1 | B | −0.05 | B | Inv. |
| 1-10 | j | 0.4 | 30 | 30 | 0.1 | B | −0.05 | B | Inv. |
| 1-11 | c | 25 | 0 | 30 | 0.1 | E | −0.45 | E | Comp. |
| 1-12 | e | 4 | 0 | 30 | 0.1 | E | −0.42 | E | Comp. |
| 1-13 | h | 0.8 | 0 | 30 | 0.1 | E | −0.48 | E | Comp. |
| 1-14 | c | 25 | 30 | 0 | 0.1 | E | −0.39 | E | Comp. |
| 1-15 | e | 4 | 30 | 0 | 0.1 | E | −0.37 | E | Comp. |
| 1-16 | h | 0.8 | 30 | 0 | 0.1 | E | −0.42 | E | Comp. |
| 1-17 | c | 25 | 30 | 30 | 0.02 | B | −0.36 | D | Comp. |
| 1-18 | e | 4 | 30 | 30 | 0.02 | B | −0.33 | D | Comp. |
| 1-19 | c | 25 | 30 | 30 | 0.05 | B | −0.14 | B | Inv. |
| 1-20 | e | 4 | 30 | 30 | 0.05 | B | −0.13 | B | Inv. |
| 1-21 | c | 25 | 30 | 30 | 0.2 | B | −0.02 | C | Inv. |
| 1-22 | e | 4 | 30 | 30 | 0.2 | B | −0.03 | B | Inv. |
| 1-23 | e | 4 | 13 | 30 | 0.1 | C | −0.12 | C | Inv. |
| 1-24 | e | 4 | 20 | 30 | 0.1 | B | −0.09 | B | Inv. |
| 1-25 | e | 4 | 38 | 30 | 0.1 | B | −0.10 | B | Inv. |
| 1-26 | e | 4 | 75 | 30 | 0.1 | B | −0.14 | C | Inv. |
| 1-27 | e | 4 | 30 | 8 | 0.1 | C | −0.11 | C | Inv. |
| 1-28 | e | 4 | 30 | 16 | 0.1 | B | −0.10 | B | Inv. |
| 1-29 | e | 4 | 30 | 20 | 0.1 | B | −0.09 | B | Inv. |
| 1-30 | e | 4 | 30 | 50 | 0.1 | C | −0.15 | C | Inv. |

As apparent from Table 1, it was shown that the use of packing material exhibiting an oxygen permeability of not more than 50 ml/m$^2$·dat·atm led to excellent results that no tarry deposit was observed in the kit and lowering of Dmax-Y and uneven development did not occur during running process.

Example 2

Running process was carried out similarly to Example 6, provided that the concentrated color developer composition was changed as below. Results are shown in Table 5.

| | |
|---|---|
| Sodium sulfite | 30 g |
| Potassium carbonate | 200 g |
| Sodium diethylenetriaminepentaacetate | 25 g |
| Potassium bromide | 1.3 g |
| Compound of formula (7), in an amount shown in Table 2 | |
| Compound (8), in an amount shown in Table 2 | |
| Hydroxylamine sulfate | 30 g |
| CD-4, in an amount shown in Table 2 | |
| pH | 10.70 |
| Water to make | 1 liter |

TABLE 2

| Expt. No. | Material | Oxygen Permeability (ml/m$^2$ · day · atm) | Compound (7) (g/l) | Compound (8) (g/l) | CD-4 (mol/l) | State of Aged Kit | ΔDmax-Y | Development Uniformity |
|---|---|---|---|---|---|---|---|---|
| 2-1 | c | 25 | — | — | 0.1 | C | −0.12 | B |
| 2-2 | c | 25 | DEG (10) | — | 0.1 | B | −0.06 | B |
| 2-3 | c | 25 | DEG (50) | — | 0.1 | A | −0.04 | B |
| 2-4 | c | 25 | — | PVP K-17 (10) | 0.1 | B | −0.06 | B |
| 2-5 | c | 25 | — | PVP K-17 (30) | 0.1 | B | −0.05 | A |
| 2-6 | e | 4 | — | — | 0.1 | B | −0.08 | B |
| 2-7 | e | 4 | DEG (10) | — | 0.1 | A | −0.05 | A |
| 2-8 | e | 4 | DEG (50) | — | 0.1 | A | −0.04 | A |

TABLE 2-continued

| Expt. No. | Material | Oxygen Permeability ($ml/m^2 \cdot day \cdot atm$) | Compound (7) (g/l) | Compound (8) (g/l) | CD-4 (mol/l) | State of Aged Kit | ΔDmax-Y | Development Uniformity |
|---|---|---|---|---|---|---|---|---|
| 2-9 | e | 4 | PEG#200 (10) | — | 0.1 | A | −0.06 | A |
| 2-10 | e | 4 | PEG#200 (50) | — | 0.1 | A | −0.03 | A |
| 2-11 | e | 4 | — | PVP K-17 (10) | 0.1 | A | −0.06 | A |
| 2-12 | e | 4 | — | PVP K-17 (30) | 0.1 | A | −0.05 | A |
| 2-13 | h | 0.8 | DEG (50) | — | 0.1 | A | −0.02 | A |
| 2-14 | h | 0.8 | DEG (50) | — | 0.2 | A | +0.03 | A |
| 2-15 | h | 0.8 | — | PVP K-17 (10) | 0.1 | A | −0.03 | A |
| 2-16 | h | 0.8 | — | PVP K-17 (30) | 0.2 | A | +0.02 | A |
| 2-17 | h | 0.8 | DEG (25) | PVP K-17 (10) | 0.1 | A | −0.01 | A |

In the Table, designations DEG and PEG#200 respectively refer to diethylene glycol and polyethylene glycol #200 (average molecular weight 200), as described earlier. As apparent from Table 3, the use of compounds represented by formula (7) or compounds (8), i.e., a polymer having a pyrrolidone nucleus in the molecule structure resulted in further enhanced effects of the invention.

Example 3

Running process was carried out similarly to Experiment No. 1-5 in Example 1, provided that processor KP-46QA was modified so that water was supplied together with developer replenishing solution to the color developing tank. The replenishing rate in the color developing step was as follows:

| Expt. No. | Replenisher | Replenishing rate |
|---|---|---|
| 3-1 | Replenishing solution | 500 $ml/m^2$ |
| 3-2 | Concentrate/water | 100 $ml/m^2$ (Concentrate)<br>400 $ml/m^2$ (Water) |

After completion of running process, evaluation was made similarly to Example 1. Results are shown in Table 3.

TABLE 3

| Experiment No. | Running Performance ΔDmax-Y | Development Uniformity |
|---|---|---|
| 3-1 | −0.08 | B |
| 3-2 | −0.03 | A |

As can be seen from Table 3, it was proved that directly replenishing the concentrated color developer composition into the developing tank of the processor also resulted further enhanced effects of the invention.

Example 4

A concentrated color developer composition was prepared in accordance with the following formula.

| | |
|---|---|
| Sodium sulfite (hereinafter, also denoted as "SS") in an amount shown in Table 4 | |
| Potassium carbonate | 190 g |
| Compound shown in Table 4 | 0.03 mol |
| Potassium bromide | 1.0 g |
| Hydroxylamine sulfate (hereinafter, also denoted as "HAS") in an amount of Table 4 | |
| CD-4 (exemplified compound A-2), in an amount shown in Table 4 | |
| pH | 10.35 |

The total volume was made to 1 liter with water and the pH was adjusted with 50% sulfuric acid or potassium hydroxide.

The concentrated color developer compositions thus prepared were put into a hermetically sealed container, which was the same as used in Experiment No. 1-7 in Example 1 and aged in an incubator maintained at 55° C. for 3 months. Before and after being aged, the concentrated color developer compositions were each diluted 7 times and the following compounds were added thereto to prepare color developer working solutions:

| | |
|---|---|
| Sodium bromide | 1.3 g/l |
| Potassium bicarbonate | 3.7 g/l |
| Potassium carbonate | 2.3 g/l |
| Potassium iodide | 3.0 mg/l |
| pH | 10.05 |

The pH was adjusted with 50% sulfuric acid or potassium hydroxide.

The thus prepared working solutions were each measured with respect to oxidation-reduction potential or redox potential (also denoted as E), using HM-30S (available from TOA Electronics Ltd.) to determine the difference in E before and after being aged (ΔE=E before aged minus E after aged). Variation of redox potential was determined according to the following equation. The less variation of redox potential indicates a kit with superior storage stability.

Redox potential variation (%)=(potential after aged/potential before aged−1)×100

Development was conducted under the following conditions, in which photographic material exposed through an optical wedge (Konica Color CENTURIA 200) was used to determine gamma balance as defined below. The less variation of gamma balance indicates less variation in processing level after being aged and superior storage stability. Gamma of blue density and that of green density, gamma balance, and variation in gamma balance between before and after being aged (expressed in %) are defined as follows:

Gamma of blue (B) density=difference between a density of minimum density (Dmin) plus 0.3 and a density at a logarithmic exposure higher by 1.5 therefrom, divided by 1.5; i.e., the difference of a higher density from a lower density, divided by 1.5;

Gamma of green (G) density=difference between a density of minimum density (Dmin) plus 0.3 and a density at a logarithmic exposure higher by 1.5 therefrom, divided by 1.5; i.e., the difference of a higher density from a lower density, divided by 1.5;

Gamma balance=gamma of B-density/gamma of G-density;

Gamma variation=(gamma balance after aged/gamma balance before aged−1)×100.

Processing Step and Condition

| Step | Time | Temperature |
|---|---|---|
| Developing | 3 min. 15 sec. | 38.0° C. |
| Bleaching | 45 sec. | 38.0° C. |
| Fixing-1 | 45 sec. | 38.0° C. |
| Fixing-2 | 45 sec. | 38.0° C. |
| Stabilizing-1 | 30 sec. | 38.0° C. |
| Stabilizing-2 | 30 sec. | 38.0° C. |
| Stabilizing-3 | 30 sec. | 38.0° C. |
| Drying | 1 min. | 55° C. |

A bleaching solution, fixing solution and stabilizing solution were each prepared according to the following formulas.

| Bleaching solution (per liter) | Worker solution |
|---|---|
| Sodium 1,3-propylenediamine-tetraacetate iron (III) | 133 g |
| 1,3-propylenediaminetetra-acetic acid | 5 g |
| Ammonium bromide | 60 g |
| Maleic acid | 40 g |
| Imidazole | 10 g |
| pH | 4.5 |

Water was added to make 1 liter and the pH was adjusted with ammonia water or 50% sulfuric acid.

| | Worker solution |
|---|---|
| Fixing solution (per liter) | |
| Ammonium thiosulfate | 200 g |
| Sodium sulfite | 15 g |
| Disodium ethylenediaminetetraacetate | 2 g |
| pH | 7.0 |
| Stabilizing solution (per liter) | |
| m-Hydroxybenzaldehyde | 1.0 g |
| Disodium ethylenediaminetetraacetate | 0.6 g |
| β-Cyclodextrin | 0.2 g |
| Potassium carbonate | 0.2 g |
| pH | 8.5 |

Results are shown in Table 1.

TABLE 4

| No. | SS (mol/l) | Compound | Has (mol/l) | CD-4 (mol/l) | Redox Potential Variation (%) | Gamma balance Variation (%) |
|---|---|---|---|---|---|---|
| 4-1 | 0.25 | DTPA | 0.10 | 0.11 | 2.9 | 4.5 |
| 4-2 | 0.10 | DTPA | 0.10 | 0.11 | 5.3 | 7.7 |
| 4-3 | 0.50 | DTPA | 0.10 | 0.11 | 3.0 | 5.1 |
| 4-4 | 1.00 | DTPA | 0.10 | 0.11 | 3.2 | 4.9 |
| 4-5 | 1.50 | DTPA | 0.10 | 0.11 | 6.3 | 8.1 |
| 4-6 | 0.25 | TTHA | 0.10 | 0.11 | 3.7 | 7.1 |
| 4-7 | 0.25 | (1)-1 | 0.10 | 0.11 | 3.0 | 5.0 |
| 4-8 | 0.25 | (1)-5 | 0.10 | 0.11 | 4.0 | 5.5 |
| 4-9 | 0.25 | (3)-1 | 0.10 | 0.11 | 4.2 | 4.6 |
| 4-10 | 0.25 | (3)-3 | 0.10 | 0.11 | 3.9 | 5.6 |
| 4-11 | 0.25 | (4)-1 | 0.10 | 0.11 | 4.9 | 4.8 |
| 4-12 | 0.25 | (4)-2 | 0.10 | 0.11 | 4.7 | 5.3 |
| 4-13 | 0.25 | DTPA | 0.03 | 0.11 | 8.1 | 7.9 |
| 4-14 | 0.25 | DTPA | 0.05 | 0.11 | 4.6 | 6.1 |
| 4-15 | 0.25 | DTPA | 0.20 | 0.11 | 3.9 | 5.5 |
| 4-16 | 0.25 | DTPA | 0.30 | 0.11 | 4.1 | 5.7 |
| 4-17 | 0.25 | DTPA | 0.40 | 0.11 | 8.6 | 9.0 |
| 4-18 | 0.25 | DTPA | 0.10 | 0.05 | 7.4 | 8.8 |
| 4-19 | 0.25 | DTPA | 0.10 | 0.08 | 4.5 | 4.4 |
| 4-20 | 0.25 | DTPA | 0.10 | 0.2 | 4.9 | 4.8 |
| 4-21 | 0.25 | DTPA | 0.10 | 0.5 | 5.0 | 4.8 |
| 4-22 | 0.25 | DTPA | 0.10 | 0.8 | 8.9 | 9.2 |
| 4-23 | 0.25 | HEDP | 0.10 | 0.11 | 13.1 | 16.5 |
| 4-24 | 0.25 | EDTA | 0.10 | 0.11 | 11.5 | 17.9 |

DTPA: Diethylenetriaminepentaacetic acid
TTHA: Triethylenetetraminehexaacetic acid
HEDP: Hydroxyethylidenediphosphonic acid
EDTA: Ethylenediaminetetraacetic acid As can be seen from the results shown in Table 4, it was proved that the combination according to the invention, specifically, the use of the compounds represented by the foregoing formulas (1) through (4) provided a concentrated color developer composition exhibiting reduced variation in redox potential between before and after being aged at a relative high temperature and reduced variation in gamma balance, leading to superior storage stability. In general, a variation in gamma balance of more than 10% results in change in print density, producing problems in practical use.

It was further proved that a sulfite of not less than 0.1 mol/l was needed and 0.2 to 1.0 mol/l was preferred, a hydroxylamine salt of not less than 0.03 mol/l was needed and 0.05 to 0.30 mol/l is preferred, and a hydroxyalkyl-substituted p-phenylenediamine type color developing agent of not less than 0.05 mol/l was needed and 0.08 to 0.5 mol/l was preferred.

Example 5

Experiments were carried out similarly to Experiment No. 4-1 in Example 4, except that the molar ratio of HAS to $K_2CO_3$ was changed as shown in Table 5. Results thereof are shown in Table 5.

TABLE 5

| No. | Has (mol/l) | $K_2CO_3$ (mol/l) | Molar Ratio (HAS:$K_2CO_3$) | Redox Potential Variation (%) | Gamma balance Variation (%) |
|---|---|---|---|---|---|
| 5-1 | 0.5 | 1.0 | 1:2 | 8.0 | 9.0 |
| 5-2 | 0.5 | 1.5 | 1:3 | 5.9 | 8.1 |
| 5-3 | 0.3 | 1.5 | 1:5 | 4.9 | 5.2 |
| 5-4 | 0.15 | 1.5 | 1:10 | 3.2 | 4.1 |
| 5-5 | 0.075 | 1.5 | 1:20 | 3.9 | 4.0 |
| 5-6 | 0.05 | 1.5 | 1:30 | 6.1 | 7.5 |
| 5-7 | 0.0375 | 1.5 | 1:40 | 8.5 | 8.9 |
| 5-8 | 0.03 | 1.5 | 1:50 | 9.0 | 9.4 |

As can be seen from Table 5, it was proved that the molar ratio of a hydroxylamine salt (HAS) to a carbonate ($K_2CO_3$) was preferably within a range of 1:3 to 1:30 and more preferably 1:5 to 1:20.

Example 6

Experiments were carried out similarly to Experiment No. 4-1 in Example 4, except that compounds shown in Table 6 was further added and the aging period was changed to 5 months at 50° C. and 55% RH. Results thereof are shown in Table 6.

TABLE 6

| No. | Compound (mol/l) | Molar Ratio (HAS:Compound) | Redox Potential Variation (%) | Gamma balance Variation (%) |
|---|---|---|---|---|
| 6-1 | — | — | 7.4 | 9.0 |
| 6-2 | DBSNa*1 (0.0003) | 1:0.003 | 7.3 | 9.5 |
| 6-3 | BCC*2 (0.0003) | 1:0.003 | 7.9 | 9.4 |
| 6-4 | (A) (0.0003) | 1:0.003 | 7.1 | 9.1 |
| 6-5 | (5)-1 (0.0003) | 1:0.003 | 3.8 | 4.6 |
| 6-6 | (5)-2 (0.0003) | 1:0.003 | 4.0 | 4.9 |
| 6-7 | (5)-6 (0.0003) | 1:0.003 | 4.9 | 5.3 |
| 6-8 | (5)-13 (0.0003) | 1:0.003 | 5.1 | 6.0 |
| 6-9 | (5)-4 (0.00003) | 1:0.0003 | 7.2 | 9.1 |
| 6-10 | (5)-4 (0.00004) | 1:0.0004 | 5.6 | 7.9 |
| 6-11 | (5)-4 (0.0001) | 1:0.001 | 2.7 | 4.1 |
| 6-12 | (5)-4 (0.0003) | 1:0.003 | 2.9 | 3.9 |
| 6-13 | (5)-4 (0.0005) | 1:0.005 | 3.1 | 4.4 |
| 6-14 | (5)-4 (0.001) | 1:0.01 | 3.5 | 4.5 |
| 6-15 | (5)-4 (0.004) | 1:0.04 | 5.5 | 7.8 |
| 6-16 | (5)-4 (0.005) | 1:0.05 | 7.1 | 9.3 |

*1Sodium dodecylbenzenesulfonate
*2Benzalkonium chloride

As apparent from the results shown in Table 6, it was proved that the use of the compound represented by formula (5) in combination effectively reduced variation in redox potential, resulting in reduced processing fluctuation (i.e., gamma balance variation).

Example 7

Similarly to Experiment No. 4-1 in Example 4, experiments were carried out, except that compound (6)-7 was further added. As a result, the redox potential variation and gamma balance variation were 2.0% and 3.0%, respectively, leading to superior results.

Example 8

Using an automatic processor shown in FIG. 2, processing was run according to the condition described below.

In the running process, commercially available photographic film, Konica Color CENTURIA 800, CENTURIA 400 and CENTURIA 100 (each of which were 35 mm side, 24 exposure) were used in a ratio of 50:25:25. The film was exposed by making practical camera exposure. The thus exposed film was processed in a volume of 50 rolls per day until the replenished volume reached 3 times the processing tank volume.

Processing Step and Condition

| Step | Time | Temperature | Repleshing Rate*1 | Tank Volume |
|---|---|---|---|---|
| Developing | 3 min. 15 sec. | 38.0° C. | Conc.*2 3 ml<br>Water 12 ml | 16.4 lit. |
| Bleaching | 45 sec. | 38.0° C. | Conc.*3 4 ml<br>Water 0 ml | 3.9 lit. |
| Fixing-1 | 45 sec. | 38.0° C. | *4 | 3.9 lit. |
| Fixing-2 | 45 sec. | 38.0° C. | Conc.*5 10 ml<br>Water 10 ml | 3.9 lit. |
| Stabilizing-1 | 30 sec. | 38.0° C. | *6 | 3.9 lit. |
| Stabilizing-2 | 30 sec. | 38.0° C. | | 3.9 lit. |
| Stabilizing-3 | 30 sec. | 38.0° C. | Conc.*7 2 ml<br>Water 38 ml | 3.9 lit. |
| Drying | 1 min. | 55° C. | | |

*1Replenishing rate, per roll of 24 exposure film
*2Concentrated color developer solution
*3Concentrated bleach solution
*4 Cascade flow from 2 to 1
*5Concentrated fixer solution
*6 Cascade flow from 3 to 2 and from 2 to 1
*7Concentrated stabilizer solution A color developing solution was prepared using a concentrated color developer composition (concentrated color developer solution) used in Experiment No. 4-1 of Example 4 that was aged at 50° C. and 55% RH for 2 months.

There were used the same color developer starting solution, bleaching solution, fixing solution and stabilizing solution as in Example 1.

Variation in redox potential of the developer working solution and variation in gamma balance between before and after running process were measured, which were 3.5% and 5.2%, respectively, and thereby, superior results were achieved.

What is claimed is:

1. A concentrated color developer composition comprising a hydroxyalkyl-substituted p-phenylenediamine type color developing agent of not less than 0.05 mol/l, a sulfite and a hydroxylamine salt, and the concentrated color developer composition being packed in a container which is comprised of a material exhibiting an oxygen permeability of not more than 50 ml/$m^2$·day·atm) for the advantage in long term storage.

2. The concentrated color developer composition of claim 1, wherein the concentrated color developer composition comprises the hydroxyalkyl-substituted p-phenylenediamine type color developing of not less than 0.05 mol/l, the sulfite of not less than 0.1 mol/l and the hydroxylamine salt of not Less than 0.03 mol/l.

3. The concentrated color developer composition of claim 1, wherein the concentrated color developer composition further comprises a compound represented by the following formulas (1) through (4):

formula (1)

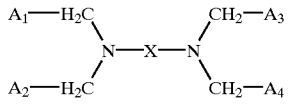

wherein $A_1$, $A_2$, $A_3$ and $A_4$ each represent —$CH_2OH$, —COOM or —$PO_3M_1M_2$, in which M, $M_1$ and $M_2$ each represent a hydrogen atom or an alkali metal atom; X represents an alkylene group having 3 to 6 carbon atoms;

formula (2)

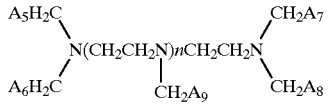

wherein $A_5$, $A_6$, $A_7$, $A_8$ and $A_9$ each represent —$COOM_3$ or —$PO_3M_4M_5$, in which $M_3$, $M_4$ and $M_5$ each represent a hydrogen atom or an alkali metal atom; n is 1 or 2;

formula (3)

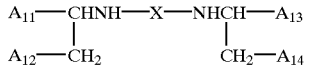

wherein $A_{11}$, $A_{12}$, $A_{13}$ and $A_{14}$ each represent —$CH_2OH$, —$PO_3(M_6)_2$ or —$COOM_7$, in which $M_6$ and $M_7$ each represent a hydrogen atom or an alkali metal atom; X represents an alkylene group having 2 to 6 carbon atoms or —$(B_1O)_n$—$B_2$—, in which $B_1$ and $B_2$ each represent an alkylene group and n is an integer of 1 to 6;

formula (4)

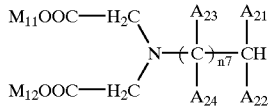

wherein $A_{21}$, $A_{22}$, $A_{23}$ and $A_{24}$ each represent a hydrogen atom, a hydroxy group, —$COOM_8$, —$PO_3(M_9)_2$, —$CH_2COOM_{10}$, —$CH_2OH$ or a lower alkyl group, provided that at least one of $A_{21}$, $A_{22}$, $A_{23}$ and $A_{24}$ is —$COOM_8$, —$PO_3(M_9)_2$ or —$CH_2COOM_{10}$; $M_8$, $M_9$, $M_{10}$, $M_{11}$ and $M_{12}$ each represent a hydrogen atom or an alkali metal atom; n7 is an integer of 0, 1 or 2.

4. The concentrated color developer composition of claim 3, wherein the compound represented by formulas (1) through (4) is contained in a concentration of 0.004 to 1.0 mol/l.

5. The concentrated color developer composition of claim 3, wherein the concentrated color developer composition further comprises an alkali metal carbonate, and a molar ratio of the hydroxylamine salt to the alkali metal carbonate being 1:3 to 1:30.

6. The concentrated color developer composition of claim 3, wherein the concentrated color developer composition further comprises a compound represented by the following formula (5):

formula (5)

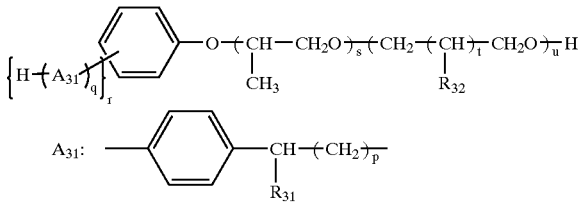

wherein $R_{31}$ represents a hydrogen atom or an alkyl group having 1 or 2 carbon atoms; $R_{32}$ represents a hydrogen atom or a hydroxyl group; p is an integer of 0 to 2, q is an integer of 1 to 3, and r is an integer of 1 to 3; s is an integer of 0 to 50, t is 0 or 1 and u is an integer of 10 to 150.

7. The concentrated color developer composition of claim 6, wherein a molar ratio of the hydroxylamine salt to the compound represented by formula (5) is 1:0.0004 to 1:0.04.

8. The concentrated color developer composition of claim 1, wherein the concentrated color developer composition further comprises a compound represented by formula (7) or a polymer having a pyrrolidone nucleus:

formula (7)

wherein R represents —$CH_2CH_2$—, —$CH_2CH_2CH_2$— or —$CH_2$—$CH(CH_3)$—; and n is an integer of 1 through 30.

9. A method for processing a silver halide color photographic material using an automatic processor, the method comprising:

exposing the photographic material and developing the exposed photographic material in a developing tank of the processor, wherein the method further comprises replenishing a replenisher solution to the developing tank, wherein the replenisher solution is a concentrated color developer composition as claimed in claim 1.

10. The method of claim 9, wherein the method further comprises replenishing water to the developing tank.

* * * * *